US006114998A

United States Patent [19]

Schefte et al.

[11] Patent Number: 6,114,998

[45] Date of Patent: Sep. 5, 2000

[54] ANTENNA UNIT HAVING ELECTRICALLY STEERABLE TRANSMIT AND RECEIVE BEAMS

[75] Inventors: Henry Schefte, deceased, late of Skärholmen, by Ann-Margret Schefte, legal representative; Sven Anders Gösta Derneryd, Hisings Backa; Jan Staffan Reinefjord, Djursholm, all of Sweden

[73] Assignee: Telefonaktiebolaget LM Ericsson (publ), Stockholm, Sweden

[21] Appl. No.: 09/163,678

[22] Filed: Sep. 30, 1998

[30] Foreign Application Priority Data

Oct. 1, 1997 [SE] Sweden ..... 9703585

[51] Int. Cl.[7] ..... H01Q 1/38

[52] U.S. Cl. ..... 343/700 MS; 343/768; 343/770

[58] Field of Search ..... 343/700 MS, 846, 343/768, 769, 770, 767; H01Q 1/38

[56] References Cited

U.S. PATENT DOCUMENTS

| | | | |
|---|---|---|---|
| 4,783,661 | 11/1988 | Smith | 343/700 |
| 4,827,271 | 5/1989 | Berneking et al. | 343/700 |
| 4,903,033 | 2/1990 | Tsao et al. | 343/700 |
| 5,003,318 | 3/1991 | Berneking et al. | 343/700 |
| 5,043,738 | 8/1991 | Shapiro et al. | 343/700 |
| 5,153,600 | 10/1992 | Metzler et al. | 343/700 |
| 5,231,407 | 7/1993 | McGirr et al. | 434/700 |
| 5,287,116 | 2/1994 | Iwasaki et al. | 343/700 |
| 5,434,580 | 7/1995 | Raguenet et al. | 343/700 |
| 5,561,434 | 10/1996 | Yamazaki | 343/700 |
| 5,650,788 | 7/1997 | Jha | 343/700 |
| 5,912,645 | 6/1999 | Wight et al. | 343/700 MS |
| 5,923,296 | 7/1999 | Sanzgiri et al. | 343/700 MS |

FOREIGN PATENT DOCUMENTS

| | | |
|---|---|---|
| 75806/94 | 5/1995 | Australia . |
| 27117/95 | 2/1996 | Australia . |
| 0649227 A1 | 4/1995 | European Pat. Off. . |
| 0696112A2 | 2/1996 | European Pat. Off. . |
| 0752735 A1 | 1/1997 | European Pat. Off. . |
| 0753897 A2 | 1/1997 | European Pat. Off. . |
| 2673496 | 9/1995 | France . |
| 56-168437 | 12/1981 | Japan . |
| 1-321738 | 12/1989 | Japan . |
| 2-48830 | 2/1990 | Japan . |
| 4-40003 | 2/1992 | Japan . |
| 4-252523 | 9/1992 | Japan . |
| 6-224622 | 8/1994 | Japan . |
| 07060777A | 3/1995 | Japan . |
| 07321548A | 12/1995 | Japan . |
| 08213835A | 8/1996 | Japan . |
| 2293277A | 3/1996 | United Kingdom . |
| WO 95/04386 | 2/1995 | WIPO . |
| WO 96/10276 | 4/1996 | WIPO . |

OTHER PUBLICATIONS

Bengtsson, R.; International–Type Search Report; Search Request No. SE 97/01184; Jun. 8, 1998, pp. 1–4.

*Primary Examiner*—Hoanganh Le
*Attorney, Agent, or Firm*—Jenkens & Gilchrist, P.C.

[57] ABSTRACT

The present invention relates to an antenna unit (101) capable of operating in a satellite communication mode. The antenna unit (101) comprises interleaved circular patches for transmitting (102) and receiving (103) radio signals periodical arranged in a first and a second layer. The patches for transmitting (102) in the first layer are arranged in a first lattice (104) and the patches for receiving (103) in the second layer are arranged in a second lattice (105). The first lattice (104) is interleaved with the second lattice (105). Every other patch for transmitting (102) in the first layer has a corresponding patch for receiving (103) in the second layer, where each of the patches for receiving (103) are arranged in such a way that a center axis of the patches for receiving (103) coincide with a center axis of the corresponding patch for transmitting (102).

27 Claims, 6 Drawing Sheets

Fig. 2b Section A–A

ANTENNA UNIT HAVING ELECTRICALLY STEERABLE TRANSMIT AND RECEIVE BEAMS

TECHNICAL FIELD OF THE INVENTION

The present invention relates to an antenna unit with a multilayer structure and interleaved antenna elements of similar type for transmitting and receiving radio signals in a satellite communication system.

DESCRIPTION OF RELATED ART

One type of radio communication is cellular mobile communication where portable radio units communicate with each other or with fixed units through mobile basestations on the ground. Portable radio units, for example mobile phones, which typically transmit and receive signals at a frequency of approximately 900 Megahertz or 1800–1900 Megahertz (MHz), are well known.

Recently it has become important for another type of radio communication, i.e. satellite communication.

In the near future, we will foresee communications by satellites directly to portable radio units. The satellites can reach portable radio units in areas where cellular communication is unavailable due to the lack of necessary cellular towers, base stations or compatible standards. Such satellite communications could allocate to the 2 Gigaherz (GHz) band and the 20/30 GHz bands. Several systems with high data rates (64 kbps and 2 Mbps) are in the planning stage.

The satellites of the systems can be of different types such as GEO (Geostationary Earth Orbit), ICO (Intermediate Circular Orbit), LEO (Low Earth Orbits) or HEO (Highly Elliptical Orbit).

It is recognised that for cellular and satellite mode communication different types of antennas are necessary since cellular antennas usually are linearly polarised and satellite antennas usually are circularly polarised. A further difference is that the satellite communication mode involves a directional component, where link-margin is increased when the satellite antenna on the portable radio unit is pointed toward the satellite, and the cellular communication mode does not usually have such a directional component. Thus, the construction of the satellite antenna is very important.

The U.S. patent with publication No. 5,434,580 describes a multi-frequency radiating array antenna comprising composite elements with a first type of microstrip patch radiating elements and a second type of wire radiating elements. These wire radiating elements are attached to coaxial cables passing through a hole in each of the microstrip patch radiating elements. The object of the patent is to provide an antenna with a single physical surface with two different types of radiating elements on a satellite to save weight and space.

The array antenna comprises additional wire radiating elements placed in a hexagonal or squared lattice around the composite elements.

The JP patent with publication number 8213835 describes an antenna in common use for two frequencies. The antenna comprises a first and a second circular patch antenna. The second patch antenna is concentric arranged above the first patch antenna. Between the antennas a dielectric layer is arranged. Under the first patch antenna is another dielectric layer arranged with a ground conductor and a filter element. The purpose of this antenna is to provide high isolation between the transmitting and the receiving signals without any addition of a large-sized and expansive signal isolation means such as a duplexer.

The JP patent with publication number 7321548 describes a microstrip antenna. The antenna comprises a disk patch antenna, a torus patch antenna and a ground conductor with slots in a layer structure.

The purpose of this antenna is to provide high isolation between the transmitting and the receiving signals.

The US patent with publication U.S. Pat. No. 5,561,434 describes a dual band phased array antenna comprising a first and a second type of antennas. The first type of antenna has mesh antenna elements for lower frequencies. The second type of antenna is an array with patches as antenna elements for higher frequencies arranged in rows and columns. The mesh antenna elements in the first antenna is transparent to the higher frequencies from the patches in the second antenna.

The US patent with publication U.S. Pat. No. 4,903,033 describes a planar dual orthogonal polarisation antenna with a radiating patch on a first dielectric. A ground plane is arranged under the first dielectric with two elongated coupling apertures at right angles to each other. One or two tuning layers with non-aperture tuning elements can be interposed between the first dielectric and the ground plane for the purpose of broadening and tuning the bandwidth of the antenna.

The JP patent with publication number 4-40003 describes a two frequency band array antenna with rectangular patches. The patches operates in a high and a low frequency band and uses two orthogonal polarised waves in common. The patches for the high band are arranged on a dielectric which in turn is arranged on the patches for the low band. Each one of the patches for the low band is arranged under patches for the high band.

As will be seen herein, each of the antennas disclosed in these patents is of a different construction than the satellite antenna of the present invention.

SUMMARY

The present invention meets a number of problems related to antenna units.

One problem is the integration of an antenna unit with transmit and receiving means in a radio unit if the antenna unit's area has to be limited to the radio unit's geometrical dimensions.

Another problem is to obtain a high antenna directivity if the antenna unit's area is limited and/or non-planar.

Still another problem occurs if the antenna unit has to search for, track and follow a distant satellite with its transmit and receiving beams. This requires that the transmit and receiving means have steerable beams which are pointing in approximately equal directions.

A further problem is to give the best possible means for an independent selection of transmit and receiving bands of the antenna unit e.g. the number of antenna elements for the transmitting and receiving means and the lattices in which the antenna elements are arranged.

Another problem occurs when radio signals to/from the antenna unit are weak due to low output power or attenuation in the radio wave propagation path. This requires a high radio unit antenna gain with extra link margin.

Yet another problem occurs when the frequencies for transmitting and receiving have to be widely separated. This requires that the number and size of antenna elements for transmitting and receiving have to be flexible.

Still another problem occurs when the transmit or the receiving beam have a higher frequency, where the beam with the higher frequency is submitted to a higher path loss than the other beam. This requires that the transmit and receiving means are arranged within approximately equal geometrical areas.

In light of the foregoing, a primary object of the present invention is to provide an antenna unit capable of operating in a satellite communication mode.

Another object of the present invention is to provide an antenna unit capable of being integrated in a portable radio unit where said antenna is conformal with a radio unit casing.

Yet another object of the present invention is to provide an antenna unit in which the transmitting and receiving means of the antenna shares the same aperture and have substantially equal scan volumes.

A further object of the present invention is to provide an antenna unit with steerable antenna beams for transmitting and receiving pointing in substantially equal directions.

Another object of the present invention is to provide an antenna unit which can switch its antenna beam direction without any mechanical arrangement.

Yet another object of the present invention is to provide a highly directional antenna unit.

A further object of the present invention is to provide an antenna unit which can obtain a high antenna gain within the constraints of a portable radio unit's geometrical dimensions to increase the margin in the link budget.

In accordance with the present invention, an antenna unit with reception and transmitting means is disclosed. The antenna unit comprises two phased array antennas with radiating elements in a multi-layered structure.

More specifically, the antenna unit comprises two interleaved phased array antennas with radiating elements of similar type, e.g. patches or slots, in a periodically variable multi-layered structure. Reception and transmitting beams to/from the arrays are electrically steerable and are pointing in substantially equal directions.

An advantage with the present invention is that the antenna unit can be arranged on a limited and non-planar antenna unit area and still obtain a high antenna directivity.

Other advantages are approximately identical scan volumes for the transmit and receiving means and that the transmit and receiving beams of the antenna unit are pointing in approximately the same direction.

Still another advantage is that the antenna unit can establish a beam sufficiently sharp to select one of several satellites in space which can be viewed from a site of the antenna unit on earth.

More advantages are that the antenna unit has no movable parts which can be broken, the beams of the antenna unit are steerable, highly directional, and they have a high transmit and receive gain.

BRIEF DESCRIPTION OF THE DRAWINGS

These above mentioned objects and other features of the present invention will become more readily apparent upon reference to the following description when taken in conjunction with the accompanying drawings.

FIG. 2*a–c* are cross-sectional views of the antenna unit according to FIG. 1.

DETAILED DESCRIPTION OF EMBODIMENTS

Figure 1:
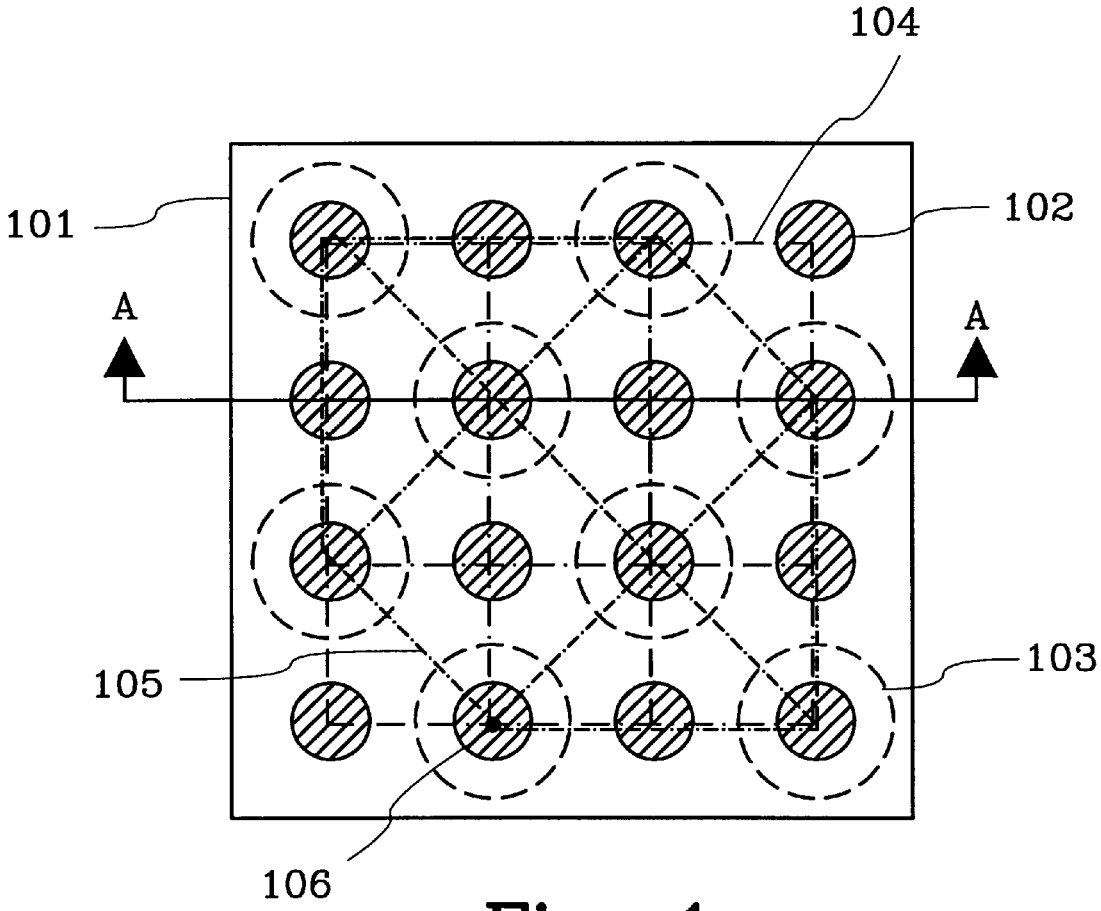
FIG. 1 is a view of a first embodiment of an antenna unit in accordance with the present invention.

FIG. 1 illustrates a view of a first embodiment of a circularly polarised antenna unit 101 according to the present invention. The antenna unit 101 comprises a first and a second phased array antenna with circular patches as radiating antenna elements. The phased array antennas 200*a*, 200*b*, respectively are illustrated in FIG. 2*b–c* and are interleaved with each other and embedded in a multi-layer structure within the antenna unit 101.

A phased array antenna in general comprises individual antenna elements of similar type, normally regularly spaced on an antenna surface. Each individual antenna element is connected to beam forming networks in which the inter-element phase shift are set on predetermined values giving the required radiation patterns.

The first phased array antenna 200*a* comprises patches for transmitting 102 arranged in a first lattice 104. The second phased array antenna 200*b* comprises patches for receiving 103 arranged in a second lattice 105. FIG. 1 shows an example of a first pattern for the first and second lattice. The patches for receiving 103 are dashed to illustrate that they are in a different layer than the patches for transmitting 102. The first and second lattices are illustrated with dashed-dotted lines 104,105 respectively in FIG. 1.

The patches for transmitting 102 are smaller and are of a larger number than the patches for receiving 103 due to a higher frequency for the transmitted radio signals than the received radio signals. The patches for receiving 103 can as an alternative be used for transmitting and the patches for transmitting 102 can be used for receiving if the received radio signals are of a higher frequency than the transmitted radio signals.

Figure 2A:
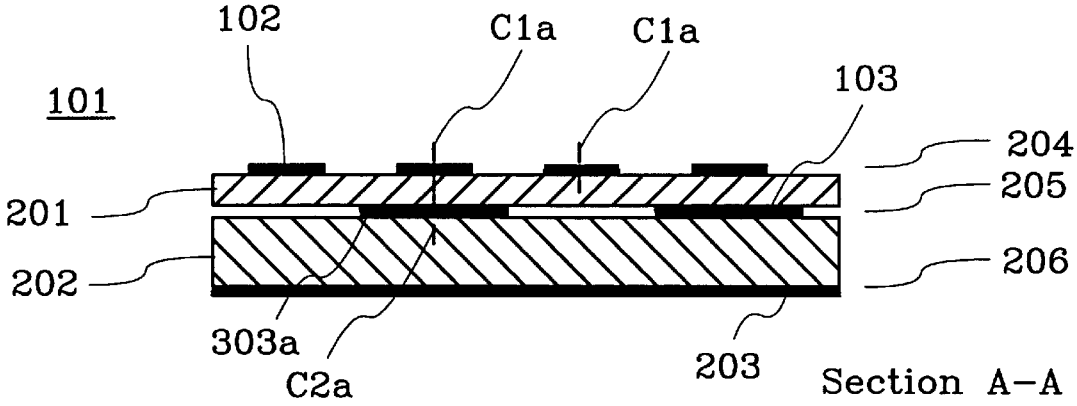
Figure 2C:
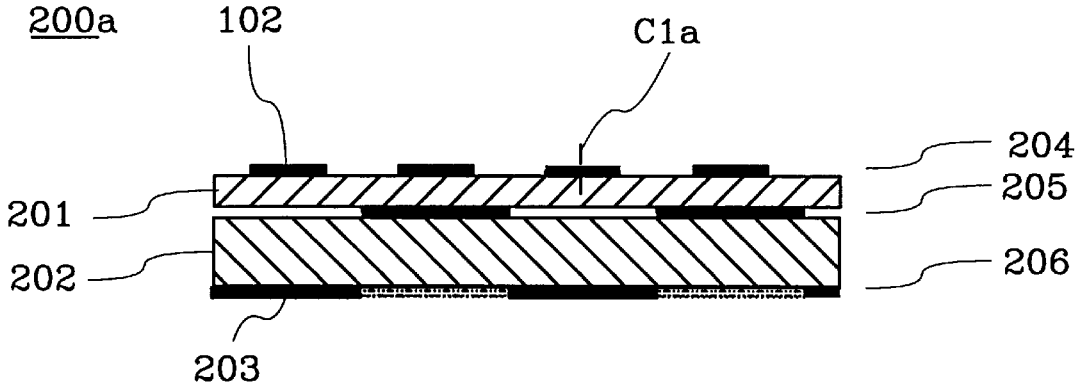
Figure 2C:
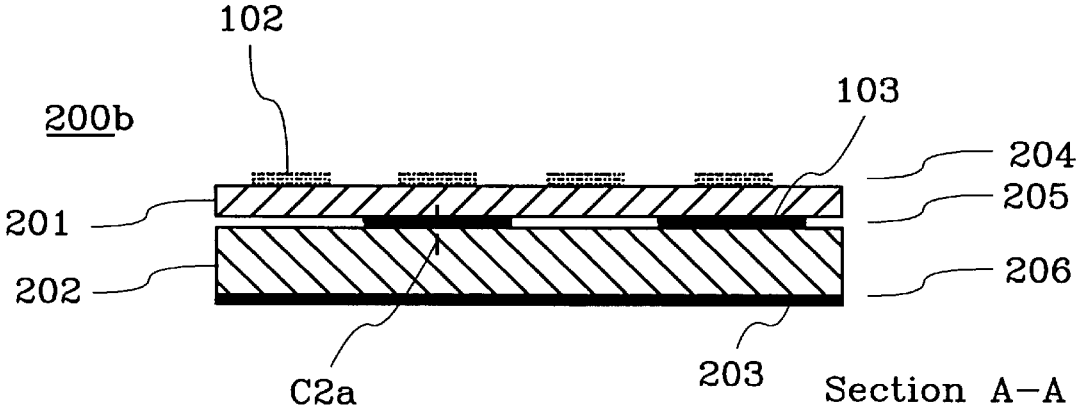

According to FIG. 2*a* which is a cross-section along line A—A, shown in FIG. 1, the first lattice 104 with patches for transmitting 102 are arranged in a first layer 204 and the second lattice 105 with patches for receiving 103 are arranged in a second layer 205. Between the first and second layer 204, 205 respectively is a first dielectrical volume 201 arranged. A ground plane 203 comprising an electrically conductive material is arranged in a third layer 206. Between the second and third layer 205, 206 respectively is a second dielectrical volume 202 arranged.

Each one of the patches for transmitting 102 in the first layer 204 has a first centre axis C1a which is extending perpendicular through said first, second and third layer 204, 205, 206 respectively. Each of the patches for receiving 103 in the second layer 205 has a second centre axis C2*a* which is extending perpendicular through said first, second and third layer 204, 205, 206 respectively.

FIG. 2*b* shows the first phased array antenna 200*a* a interleaved with the second phased array antenna 200*b*. Parts of the ground plane 203 in the third layer 206 is dotted to illustrate that those parts do not belong to the first array antenna 200*a*.

Figure 3:
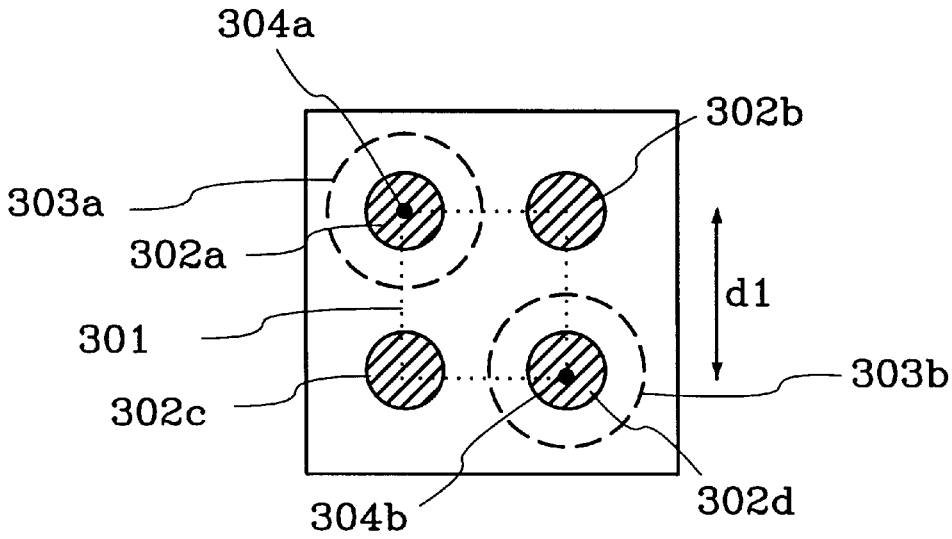
FIG. 3 is an illustration of a first pattern of patches.

FIG. 2*c* shows the second phased array antenna 200*b* interleaved with the first phased array antenna 200*a*. The patches for transmitting 102 of the first phased array antenna 200*a* is dotted to illustrate that they are not part of the second array antenna 200*b*. The ground plane 203 in the third layer 206 and the first dielectrical volume 201 are common for both array antennas 200*a*, 200*b* respectively. FIG. 3 shows a part of the first example of the first and second lattice 104,105 respectively forming the first pattern, where four patches for transmitting 302*a–d* in the first layer 204 are arranged in a square 301. Each of their centre axis's C1a are situated in the corners of the square 301. Patch 302*a* is a first patch for transmitting diagonal arranged to patch 302*d* which is a fourth patch for transmitting in the first lattice 104. The square 301 is illustrated in the figure by a dotted line. A distance d1 from one centre axis C1*a* to another centre axis C1*a* along a side of the square 301 is determined by the transmitting frequency in a known way to avoid the generation of grating lobes.

A first patch for receiving 303*a* in the second lattice 105 is arranged in the second layer 205 in such a way that the centre axis C2*a* of the first patch 303*a* coincide with the centre axis C1*a* of the first patch for transmitting 302*a*, see FIG. 2*a*. A second patch for receiving 303*b* in the second lattice 105 is arranged in the second layer 205 in such a way that the centre axis C2*a* of the second patch 303*b* coincide with the centre axis C1*a* of the fourth patch for transmitting 302*d*.

The patches for transmitting 302*a–d* and receiving 303*a–b* define various transmit and receive nodes according to the following:

The first patch for transmitting 302*a* in the first lattice 104 defines a first transmit node;

The fourth patch for transmitting 302*d* in the first lattice 104 defines a fourth transmit node;

The first patch for receiving 303*a* in the second lattice 105 defines a first receive node;

The second patch for receiving 303*b* in the second lattice 105 defines a second receive node.

The first transmit node of the first lattice 104 in the first layer 204 and the first receive node of the second lattice 105 in the second layer 205 defines a first common node 304*a* for both of the phased array antennas 200*a*, 200*b* respectively in the antenna unit 101.

The fourth transmit node of the first lattice 104 in the first layer 204 and the second receive node of the second lattice 105 in the second layer 205 defines a second common node 304*b* for both of the phased array antennas 200*a*,200*b* respectively in the antenna unit 101.

The patches for transmitting 302*a*–302*d* respectively in the first layer 204 functions as driver patches for the first phased array antenna 200*a*. The patches for receiving 303*a* and 303*b* in the second layer 205 functions as driver patches for the second phased array antenna 200*b*. In the first and second common node 304*a*, 304*b* respectively the patches for transmitting 302*a*, 302*d* respectively in the first layer 204 functions as parasitic elements for the patches for receiving 303*a*, 303*b* respectively in the second layer 205. The ground plane 203 in the third layer 206 functions as a ground plane 203 for both phased array antennas 200*a*,200*b* respectively in the antenna unit 101.

The first pattern of the first and second lattice 104,105 respectively according to FIG. 3 is repeated in the whole antenna unit 101 as seen in FIG. 1. This implies that said first and second lattice 104,105 respectively are interleaved with each other in such a way that each one of the patches for receiving 103 in the second lattice 105 forms a common node 106 with every other patch for transmitting 102 in the first lattice 104.

The patches for transmitting 102 in the first layer 204 and the patches for receiving 103 in the second layer 205 are arranged in two interleaved lattices 104,105 respectively which constitute a periodically multilayer structure in the antenna unit 101. (The number of patches varies in a periodical way within the antenna unit 101.)

The interleaved lattices 104,105 respectively in the antenna unit 101 makes it possible to configure the first lattice 104 in a rectangular, triangular, pentagonal or hexagonal pattern to adopt to the differences between the wave length of the first and second phased array antenna 200*a*, 200*b* respectively.

Figure 4:
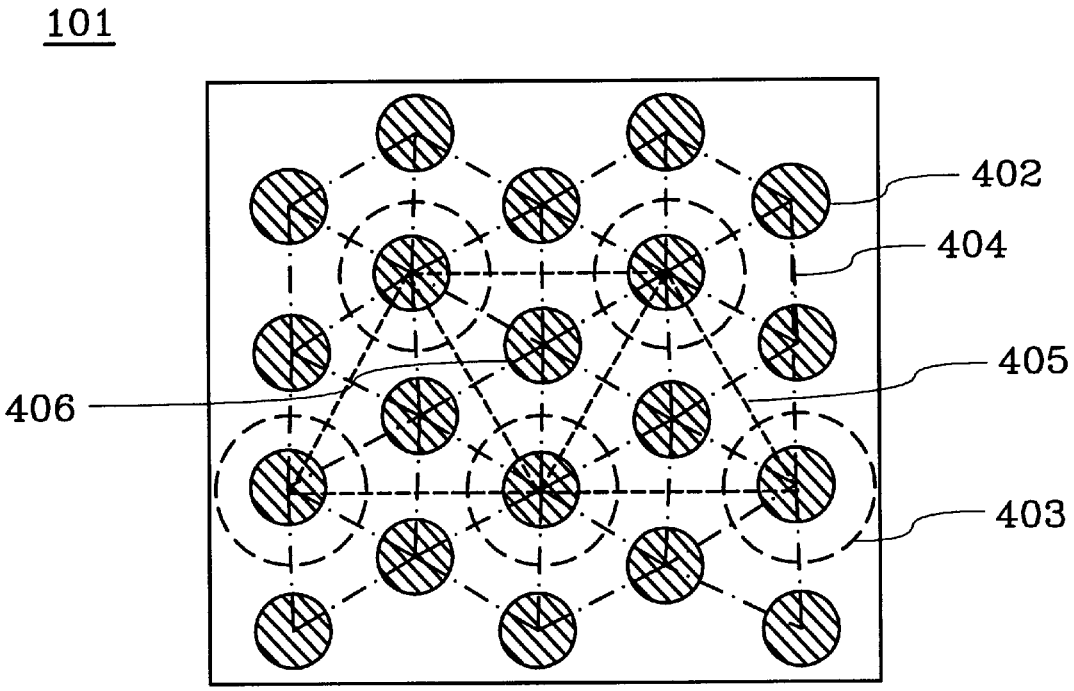
FIG. 4 is an illustration of a second pattern of patches.

FIG. 4 shows a second example of a first and a second lattice 404,405 respectively with circular patches as radiating antenna elements 402,403 in the antenna unit 101.

Figure 5:
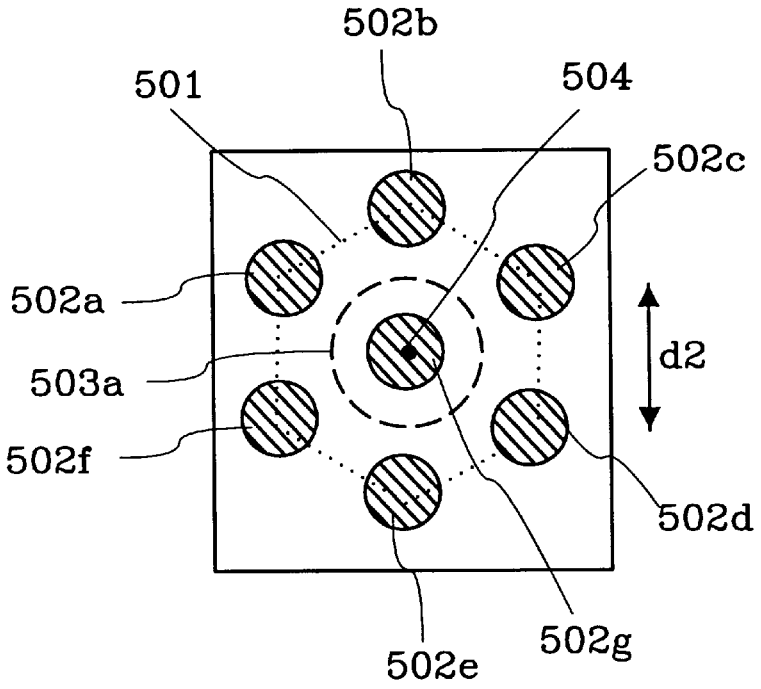
FIG. 5 is a view of a part of the pattern according to FIG. 4.

FIG. 5 shows a part of the second example of the first and second lattice 404,405 respectively forming a second pattern. The first lattice 404 in the first layer 204 has six patches for transmitting 502*a–f* arranged in a uniform hexagon 501 in such a way that each one of their centre axis C1*a* are situated in the corners of the hexagon 501 (a hexagonal lattice). The hexagon 501 is illustrated in the figure by a dotted line. One centre patch for transmitting 502*g* is arranged in the middle of the hexagon 501.

A distance d2 from one centre axis C1*a* to another centre axis C1*a* along a side of the hexagon 501 is determined by the transmitting frequency in a known way to avoid the generation of grating lobes.

A first patch for receiving 503*a* in the second lattice 405 is arranged in the second layer 205 in such a way that the centre axis C2*a* of the first patch 503*a* coincide with the centre axis C1*a* of the centre patch for transmitting 502*g*.

The centre patch for transmitting 502*g* defines a first transmit node in the first lattice 404. The first patch for receiving 503*a* defines a first receive node in the second lattice 405.

The first transmit node of the first lattice 404 in the first layer 204 and the first receive node of the second lattice 405 in the second layer 205 defines a common node 504 for both of the phased array antennas 200*a*,200*b* respectively in the antenna unit 101.

The patches for transmitting 502*a–g* respectively in the first layer 204 functions as driver patches for the first phased array antenna 200*a*. The patch for receiving 503*a* in the second layer 205 functions as a drive patch for the second phased array antenna 200*b*. In the common node 504 the patch for transmitting 502*g* in the first layer 204 functions as parasitic element for the patch for receiving 503*a* in the second layer 205. The ground plane 203 in the third layer 206 functions as a ground plane 203 for both phased array antennas 200*a*, 200*b* respectively in the antenna unit 101.

The second pattern of the first and second lattice 404,405 respectively according to FIG. 5 is repeated in the whole antenna unit 101 in such a way that three adjacent hexagons 501 of patches for transmitting 402 have one patch in common 406, see FIG. 4.

The interleaved lattices 404,405 respectively in the antenna unit 101 makes it possible to configure the first lattice 404 in a rectangular, triangular, pentagonal or hexagonal pattern to adopt to the differences between the wave length of the first and second phased array antenna 200*a*, 200*b* respectively.

The patches for transmitting and receiving in the antenna unit 101 can e.g. be circular or rectangular in shape. Rectangular shaped patches are not shown in any figure.

Figure 6:
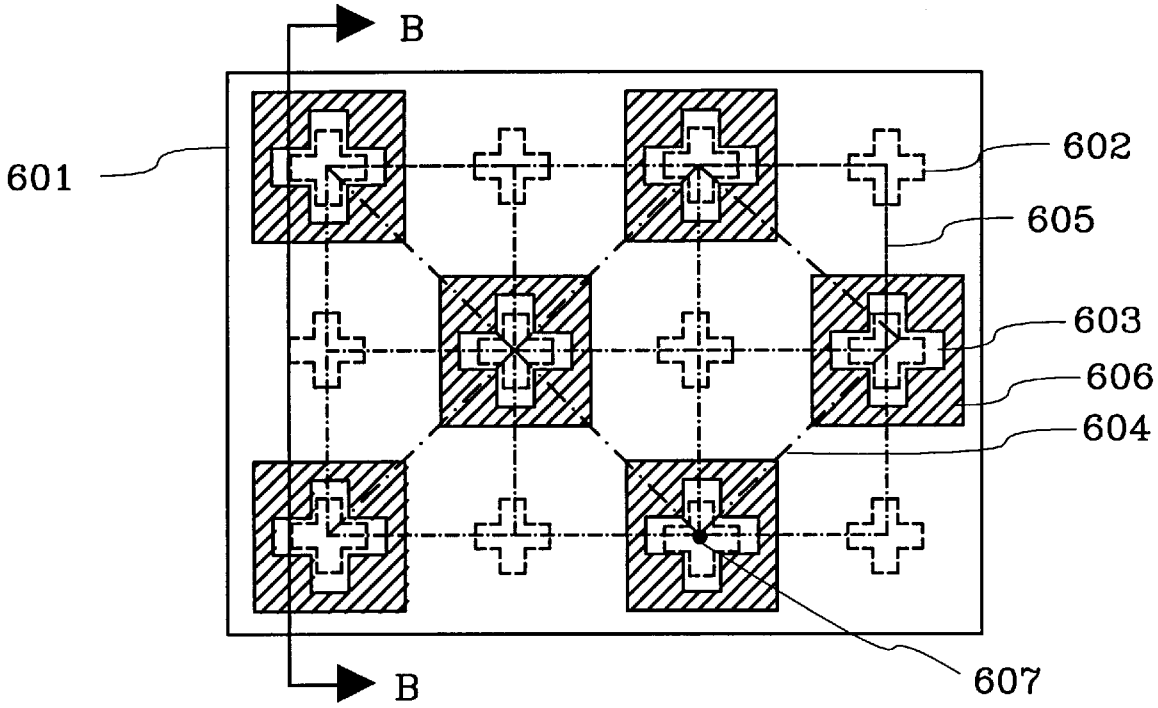
FIG. 6 is a view of a second embodiment of an antenna unit in accordance with the present invention.

FIG. 6 illustrates a view of a second embodiment of a circularly polarised antenna unit 601 according to the present invention. The antenna unit 601 comprises a first and a second phased array antenna with cross formed slots as radiating antenna elements. The phased array antennas 700*a*, 700*b* respectively are illustrated in FIG. 7*b–c* and are interleaved with each other and embedded in a multi-layer structure within the antenna unit 601.

The first phased array antenna 700*a* comprises slots for receiving 603 arranged in a first lattice 604.

The second phased array antenna 700*b* comprises slots for transmitting 602 arranged in a second lattice 605.

FIG. 6 shows an example of a pattern for the first and second lattice. The first and second lattices are illustrated with dashed-dotted lines 604,605 respectively in FIG. 6.

The cross formed slots for transmitting 602 in the second lattice 605 are dashed to illustrate that they are in a different layer than the slots for receiving 603 in the first lattice 604.

Each slot 603 for receiving in the first lattice 604 is arranged in a centre of a rectangular ground plane 606 of a limited area. This implies that there are as many slots 603 as rectangular ground planes 606. The rectangular ground planes 606 is electromagnetically sufficiently large but small enough to fit into the first lattice 604.

The slots for transmitting 602 are smaller and of a larger number than the slots for receiving 603 due to a higher frequency for the transmitted radio signals than the received radio signals.

The slots for receiving 603 can as an alternative be used for transmitting and the slots for transmitting 602 can be used for receiving if the received radio signals are of a higher frequency than the transmitted radio signals.

The ground planes 606 can have other shapes than rectangular e.g. a circular shape.

The slots for transmitting and receiving in the antenna unit 601 can have other shapes than a cross e.g. linear shaped slots arranged in orthogonal pairs. According to FIG. 7*a* which is a cross-section along line B—B, shown in FIG. 6, the first lattice 604 with the slots for receiving 603 are arranged in a first layer 702 and the second lattice 605 with the slots for transmitting 602 are arranged in a conductive second layer 703.

Between the first and second layer 702,703 respectively is the first dielectrical volume 201 arranged. The ground plane 203 comprising an electrically conductive material is arranged in a third layer 704. Between the second and third layer 703,704 respectively is the second dielectrical volume 202 arranged.

Each of the slots for receiving 603 in the first layer 702 has a second centre axis C2*b* which is extending perpendicular through said first, second and third layer 702, 703, 704 respectively. Each of the slots for transmitting 602 in the second layer 703 has a first centre axis C1*b* which is extending perpendicular through said first, second and third layer 702, 703, 704 respectively.

FIG. 7*b* shows the first phased array antenna 700*a* interleaved with the second phased array antenna 700*b*, where the conductive second layer 703 with the slots for transmitting 602 in the second phased array antenna 700*b* functions as a solid ground plane not perturbed by the slots 602. The remaining part of the second phased array antenna 700*b* is dotted.

FIG. 7*c* shows the second phased array antenna 700*b* interleaved with the first phased array antenna 700*a*, where the slots for receiving 603 of the first phased array antenna 700*a* is dotted.

Figure 8:
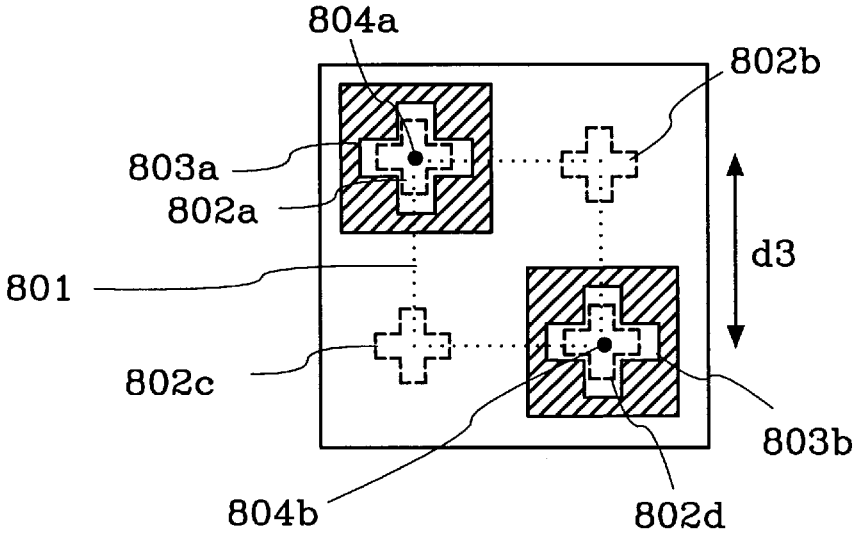
FIG. 8 is an illustration of a pattern of slots.

FIG. 8 shows a part of the example of the first and second lattice 604,605 respectively forming a pattern, where four slots for transmitting 802*a–d* in the second layer 703 are arranged in a square 801. Each of their centre axis's C1*b* are situated in the corners of the square 801. A first slot for transmitting 802*a* is diagonal arranged to a fourth slot for transmitting 802*d* in the second lattice 605 of the antenna unit 601. The square is illustrated in the figure by a dotted line.

A distance d3 from one centre axis C1*b* to another centre axis C1*b* along a side of the square 801 is determined by the transmitting frequency in a known way to avoid the generation of grating lobes.

Figure 7A:
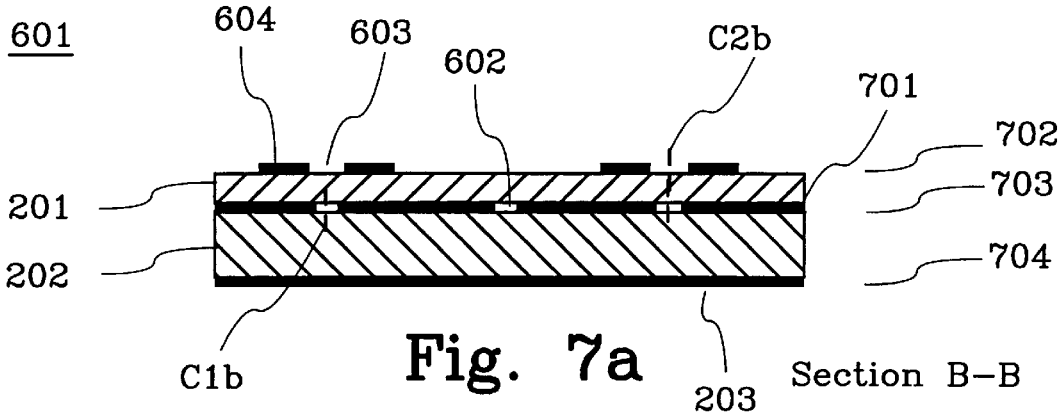
FIG. 7*a–c* are a cross-sectional views of the antenna unit according to FIG. 6.
Figure 7B:
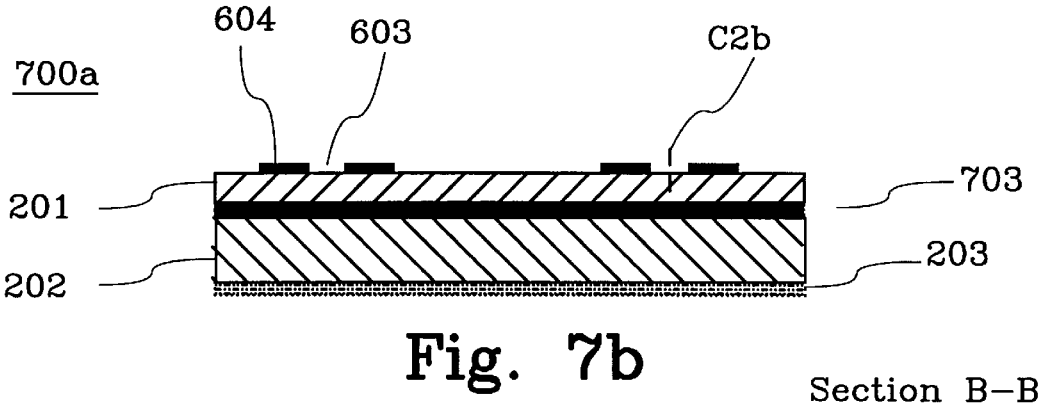
Figure 7C:
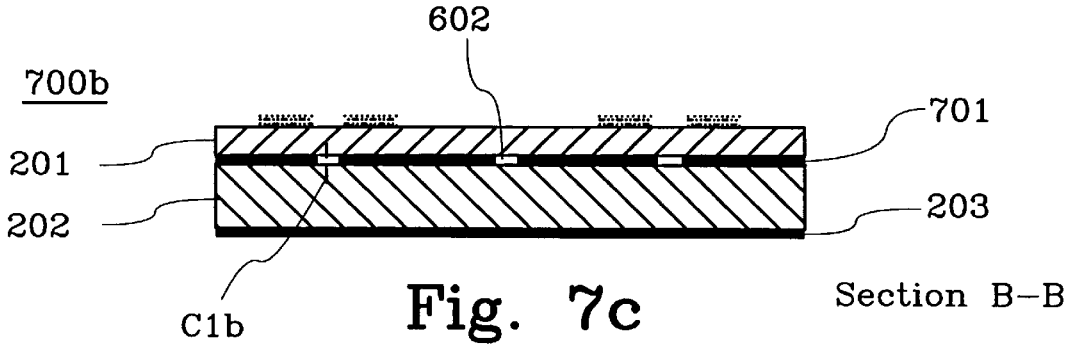

A first slot for receiving 803*a* in the first lattice 604 is arranged in the first layer 702 in such a way that the centre axis C2*b* of the first slot for transmitting 803*a* coincide with the centre axis C1*b* of slot 802*a* in the second layer 703, see FIG. 7*a*.

A second slot for receiving 803*b*, see FIG. 8, is arranged in the first layer 702 in such a way that the centre axis C2*b* of the second slot 803*b* coincide with the centre axis C1*b* of the fourth slot for transmitting 802*d* in the second layer 703.

The slots for transmitting 802*a–d* and receiving 803*a–b* define various transmit and receive nodes according to the following:

The first slot for transmitting 802*a* in the second lattice 605 defines a first transmit node;

The fourth slot for transmitting 802*d* in the second lattice 605 defines a fourth transmit node;

The first slot for receiving 803*a* in the first lattice 604 defines a first receive node;

The second slot for receiving 803*b* in the first lattice 604 defines a second receive node.

The first receive node in the first lattice 604 and the first transmit node in the second lattice 605 defines a first common node 804*a* for both of the phased array antennas 700*a*,700*b* respectively in the antenna unit 601.

The second receive node in the first lattice 604 and the fourth transmit node in the second lattice 605 defines a second common node 804*b* for both of the phased array antennas 700*a*,700*b* respectively in the antenna unit 601.

The slots for receiving 803*a* and 803*b* in the first layer 702 functions as driver slots for the first phased array antenna 700*a*. The slots for transmitting 802*a*–802*d* in the second layer 703 has a first function as driver slots for the second phased array antenna 700*b* and a second function as a ground plane for the receiving frequency, which is lower than the transmitting frequency, of the first phased array antenna 700*a*. The conductive second layer 205 in which the slots for transmitting 802*a*–802*d* are arranged functions as a single ground plane for the first phased array antenna 700*a* in the antenna unit 601.

The ground plane 203 in the third layer functions as a single ground plane 203 for the second phased array antenna 700*b* in the antenna unit 601.

The pattern of the first and second lattice 604,605 respectively according to FIG. 8 is repeated in the whole antenna unit 601 as seen in FIG. 6. This implies that each one of the slot for receiving 603 in the first lattice 604 forms a common node 607 with every other slot for transmitting 602 in the second lattice 605 as seen in FIG. 7*a*.

The slots for receiving 603 in the first layer 702 and the slots for transmitting 602 in the second layer 703 are arranged in two interleaved lattices which constitute a periodically multilayer structure in the antenna unit 601.

The interleaved lattices 604,605 respectively in the antenna unit 601 makes it possible to configure the second lattice 605 in a rectangular, triangular, pentagonal or hexagonal pattern to adopt to the differences between the wave length of the first and second phased array antenna 700*a*, 700*b* respectively.

The size of and the distances between the slots in the antenna unit 601, according to FIG. 8, is determined by the transmit and receive frequencies in a known way to avoid the generation of grating lobes.

Each one of the antenna units 101 and 601 of the present invention comprises beam forming networks to distribute RF (Radio Frequency) power to/from the patches and slots in the antenna units 101 and 601 in a known way.

Figure 9:
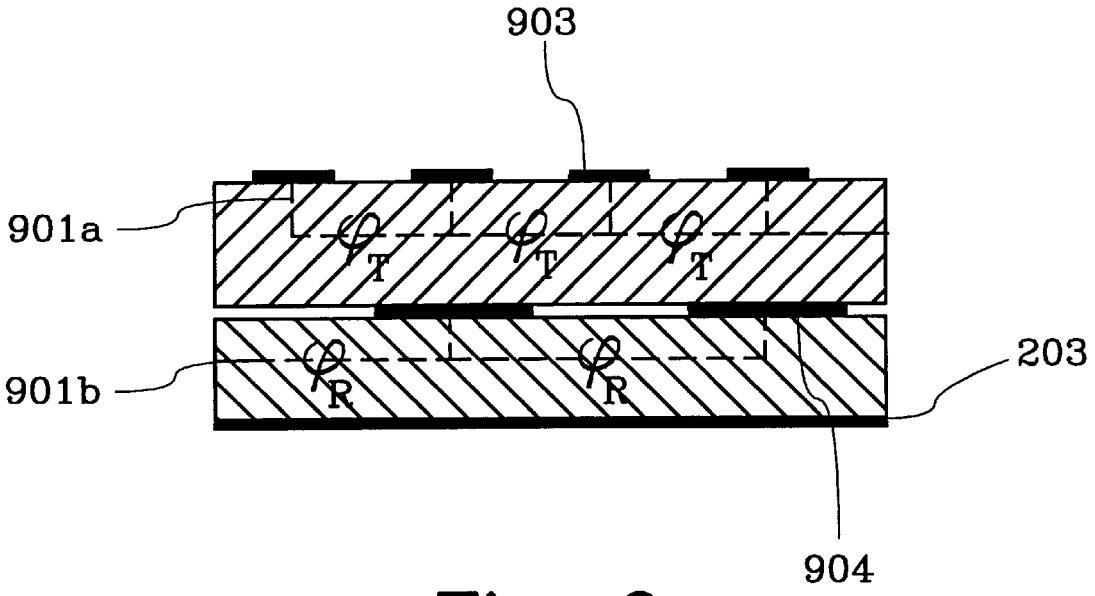
FIG. 9 is a cross-sectional view of an antenna unit with beam forming networks.

FIG. 9 illustrates an example of two analog phased delay beam forming networks 901*a*, 901*b* respectively connected to the radiating elements 903 and 904 of the antenna units 101,601 respectively. A ϕ-symbol in the figure illustrates that the phase is changed.

The beam forming could also be performed by digital signal processing at IF or base band frequency level.

The antenna units 101 and 601 can as an example be used for frequencies above 10 GHz. As example of transmission and frequency bands and the ratio between those bands the 20 and 30 GHz bands can be mentioned for receiving and transmitting respectively, which gives a ratio of 1.5.

We claim:

1. A multilayer antenna unit having electrically steerable transmit and receive beams comprising:

a first array antenna;

a second array antenna;

a first layer having a plurality of antenna elements arranged in a first lattice wherein said first lattice forms a portion of said first array antenna, said first layer for transmitting radio signals;

a second layer having a plurality of antenna elements arranged in a second lattice wherein said second lattice forms a portion of said second array antenna for receiving radio signals;

a third layer of an electrically conductive material forming a ground plane;

a first dielectric layer arranged between said first and second layer;

a second dielectric layer arranged between said second and third layer; and wherein said first and second array antenna are embedded in said antenna unit in a periodical multi-layer structure where said first lattice is interleaved with said second lattice, and further wherein said transmit and receive beams of said antenna unit have the capability of pointing in substantially equal directions in substantially equal scan volumes.

2. The antenna unit, as recited in claim 1, wherein said first and said second array antenna are phased array antennas, and further wherein said antenna elements for receiving are of a similar type as said antenna elements for transmitting.

3. The antenna unit, as recited in claim 1, wherein said antenna elements for transmitting are patches of an electrically conductive material and have a first center axis extending perpendicular through said first, second and third layers, and further wherein said antenna elements for receiving are patches of an electrically conductive material and have a second center axis extending perpendicular through said first, second and third layers.

4. The antenna unit, as recited in claim 3, wherein each of said patches for receiving are arranged in said second lattice in such a way that said second center axis of each of said patches for receiving coincide with said first center axis of every other of said patches for transmitting in said first lattice.

5. The antenna unit, as recited in claim 3, wherein said antenna elements for transmitting and receiving are arranged to transmit and receive circularly polarized radio signals.

6. The antenna unit, as recited in claim 3, wherein said first lattice is a rectangular lattice.

7. The antenna unit, as recited in claim 3, wherein said first lattice is a hexagonal lattice.

8. The antenna unit, as recited in claim 3, wherein said antenna unit comprises beam forming networks.

9. The antenna unit, as recited in claim 3, wherein said antenna elements for transmitting transmit on a first frequency and said antenna elements for receiving receive on a second frequency, wherein a ratio between said first and second frequency is substantially within the range of 1.2 to 2.0.

10. The antenna unit, as recited in claim 3, wherein said patches for transmitting and receiving are circular in shape.

11. The antenna unit, as recited in claim 3, wherein said patches for transmitting and receiving are rectangular in shape.

12. A multilayer antenna unit having electrically steerable transmit and receive beams comprising:

a first array antenna;

a second array antenna;

a first layer having a plurality of antenna elements arranged in a first lattice wherein said first lattice forms a portion of said first array antenna, said first layer for receiving radio signals;

a second layer having a plurality of antenna elements arranged in a second lattice wherein said second lattice forms a portion of said second array antenna, said second layer for transmitting radio signals;

a third layer of an electrically conductive material forming a ground plan;

a first dielectric layer arranged between said first and second layer;

a second dielectric layer arranged between said second and third layer; and wherein said first and second array antenna are embedded in said antenna unit in a periodical multi-layer structure where said first lattice is interleaved with said second lattice, and further wherein said transmit and receive beams of said antenna unit have the capability of pointing in substantially equal directions in substantially equal scan volumes.

13. The antenna unit, as recited in claim 12, wherein said first and second array antenna are phased array antennas, and further wherein said antenna elements for receiving are of a similar type as said antenna elements for transmitting.

14. The antenna unit, as recited in claim 12, wherein said antenna elements for transmitting are slots arranged in said second layer which is electrically conductive and wherein said slots for transmitting have a first center axis extending perpendicular through said first, second and third layers, and further wherein said antenna elements for receiving are slots having a second center axis extending perpendicular through said first, second and third layer.

15. The antenna unit, as recited in claim 14, wherein said first layer comprises a plurality of ground planes of a limited size, wherein each one of said ground planes comprises one of said slots for receiving.

16. The antenna unit, as recited in claim 15, wherein each of said slots for receiving are arranged in said first layer in such a way that said second center axis of each of said slots for receiving coincide with said first center axis of every other slot for transmitting in said second lattice.

17. The antenna unit, as recited in claim 15, wherein said slots for transmitting are linear slots arranged in orthogonal pairs.

18. The antenna unit, as recited in claim 15, wherein said slots for receiving are linear slots arranged in orthogonal pairs.

19. The antenna unit, as recited in claim 15, wherein said slots for transmitting are shaped like a cross.

20. The antenna unit, as recited in claim 15, wherein said slots for receiving are shaped like a cross.

21. The antenna unit, as recited in claim 15, wherein said ground planes in which each of said slots for receiving are arranged, are rectangular in shape.

22. The antenna unit, as recited in claim 15, wherein said ground planes in which each of said slots for receiving are arranged, are circular in shape.

23. The antenna unit, as recited in claim 15, wherein said antenna elements for transmitting and receiving are arranged in to transmit and receive circularly polarized radio signals.

24. The antenna unit, as recited in claim 15, wherein said first and second lattice in said first and second layer are rectangular lattices.

25. The antenna unit, as recited in claim 15, wherein said second lattice in said second layer is a hexagonal lattice.

26. The antenna unit, as recited in claim 15, wherein said antenna unit comprises beam forming networks.

27. The antenna unit, as recited in claim 15, wherein said antenna elements for transmitting transmit on a first frequency and said antenna elements for receiving receives on a second frequency, where a ratio between said first and second frequency is substantially within the range of 1.2 to 2.0.

* * * * *